US009616492B2

(12) United States Patent
Vecchio et al.

(10) Patent No.: US 9,616,492 B2
(45) Date of Patent: Apr. 11, 2017

(54) CORE MAKING METHOD AND APPARATUS

(71) Applicant: PCC AIRFOILS, INC., Beachwood, OH (US)

(72) Inventors: Anthony Vecchio, Seven Hills, OH (US); Luke Rodgers, Painesville, OH (US); Jack Guritza, South Euclid, OH (US)

(73) Assignee: PCC Airfoils, Inc., Beachwood, OH (US)

( * ) Notice: Subject to any disclaimer, the term of this patent is extended or adjusted under 35 U.S.C. 154(b) by 80 days.

(21) Appl. No.: 14/487,241

(22) Filed: Sep. 16, 2014

(65) Prior Publication Data

US 2016/0074931 A1 Mar. 17, 2016

(51) Int. Cl.

| | |
|---|---|
| ***B22C 9/10*** | (2006.01) |
| ***B22C 9/22*** | (2006.01) |
| ***B22C 9/12*** | (2006.01) |
| ***B22C 9/24*** | (2006.01) |

(52) U.S. Cl.

CPC ..... *B22C 9/10* (2013.01); *B22C 9/12* (2013.01); *B22C 9/22* (2013.01); *B22C 9/24* (2013.01)

(58) Field of Classification Search

CPC .. C04B 35/64; B22C 9/10; B22C 9/12; B22C 9/22

USPC ..... 164/23, 24, 28, 369, 516–529

See application file for complete search history.

(56) References Cited

U.S. PATENT DOCUMENTS 2,525,407 A * 10/1950 Frei, Jr. ..... B22D 27/08 164/34
3,701,379 A 10/1972 Fassler et al.
4,174,950 A * 11/1979 Jalbert ..... B22C 9/12 248/346.11
5,014,763 A 5/1991 Frank
5,181,550 A 1/1993 Blazek et al.
5,295,530 A 3/1994 O'Connor et al.
5,296,308 A 3/1994 Caccavale et al.
5,465,780 A * 11/1995 Muntner ..... B22C 9/04 164/369
5,599,166 A * 2/1997 Deptowicz ..... B22C 9/04 164/369
6,347,660 B1 2/2002 Sikkenga et al.
6,403,020 B1 6/2002 Altoonian et al.
6,583,394 B2 * 6/2003 Araya ..... B28B 11/243 219/685
6,626,230 B1 * 9/2003 Woodrum ..... B22C 1/22 164/137

(Continued)

OTHER PUBLICATIONS

Definition of wax, https://en.wikipedia.org/wiki/Wax, date unknown.*

*Primary Examiner* — Kevin E Yoon

(74) *Attorney, Agent, or Firm* — Tarolli, Sundheim, Covell & Tummino LLP

(57) ABSTRACT

A ceramic mixture is shaped to form a ceramic core having a configuration which corresponds to the configuration of a cavity in an airfoil. The ceramic core is positioned between a plurality of arrays of burners. Flames from the burners burn organic material contained in the ceramic core. During burning of the organic material, the core is upright with a longitudinal central axis of the core in a generally vertical orientation. The ceramic core may be dipped in a ceramic material after having performed the step of burning organic material and prior to additional heat treatment of the ceramic core.

11 Claims, 6 Drawing Sheets

(56) References Cited

U.S. PATENT DOCUMENTS

| | | | |
|---|---|---|---|
| 7,780,905 | B2 | 8/2010 | Dodds |
| 2004/0159985 | A1 | 8/2004 | Altoonian et al. |
| 2010/0319870 | A1 | 12/2010 | Bewlay et al. |

* cited by examiner

CORE MAKING METHOD AND APPARATUS

BACKGROUND OF THE INVENTION

The present invention relates to a method and apparatus for use in making a core which is used in the casting of an airfoil having an internal cavity.

Ceramic cores for use in making airfoils have previously been made by shaping a ceramic mixture to form a green core having a configuration which is a function of the configuration of a cavity in a metal airfoil. The green core may be initially heated to improve its strength and retain surface condition. After the initial heating and burn off of organic materials, the core may be supported on a setter block and sintered in a kiln. The kiln fire process may take up to 24 hours. After the kiln fire process, voids may be left behind within the core. The voids may be filled by dipping the core in a ceramic material. The core is sintered in a kiln a second time after being dipped in the ceramic material.

Known methods and apparatus for use in making known cores are disclosed in U.S. Pat. Nos. 3,701,379; 5,014,763; 5,296,308; 6,347,660; 6,403,020; and 7,780,905. In addition, apparatus for use in making cores is disclosed in U.S. Patent Publication Nos. 2004/0159985 A1 and 2010/0319870 A1.

SUMMARY OF THE INVENTION

The present invention relates to a new and improved method and apparatus for use in making a core. The core may be used in casting an airfoil having an internal cavity. To make the core, a ceramic mixture is shaped to form a ceramic core having a configuration which is a function of the configuration of the cavity in the airfoil.

Once it has been formed, the ceramic core may be positioned between a plurality of arrays of burners. Flames from the arrays of burners are directed against surfaces on opposite sides of the ceramic core. This results in a burning of organic material contained in the ceramic core. The ceramic core may, if desired, be supported with a central axis of the ceramic core in an upright orientation during burning of organic material contained within the ceramic core. The firing of the ceramic core in the plurality of burners may remove the need for the long kiln fire process.

BRIEF DESCRIPTION OF THE DRAWINGS

The foregoing and other features of the present invention will become more apparent upon a consideration of the following description taken in connection with the accompanying drawings wherein.

DESCRIPTION OF THE EMBODIMENTS

A ceramic core 10 is used in the casting of an airfoil having an internal cavity. The ceramic core 10 has a configuration which corresponds to the configuration of the cavity in the airfoil. Since known metal airfoils have cavities with many different configurations, it is contemplated that the ceramic core 10 may be formed with any one of many different configurations, such as the configurations illustrated in U.S. Pat. No. 4,583,581 and/or U.S. Pat. No. 5,599,166. Of course, the ceramic core 10 may have a configuration which is different than the configurations illustrated in these U.S. patents.

Figure 1:
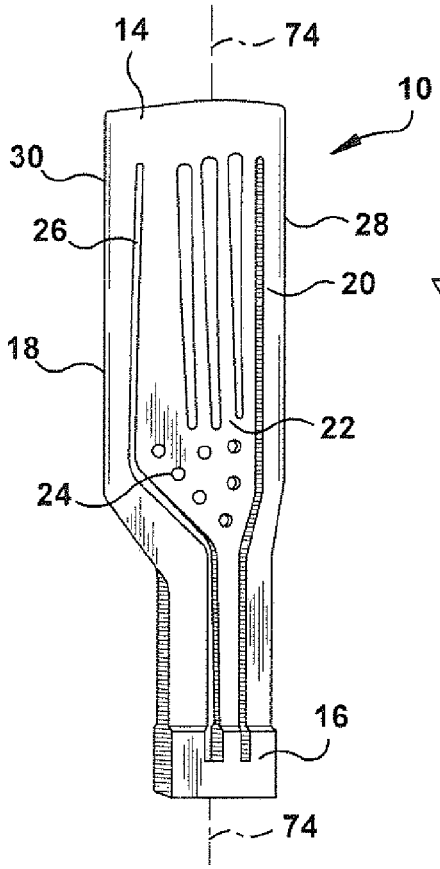
FIG. 1 is a schematic illustration of a known ceramic core for use in casting an airfoil having an internal cavity.

The ceramic core 10 is used to form a cavity in a metal airfoil, specifically in a cast nickel chrome super alloy airfoil. However, the airfoil may be formed of a different material if desired. The specific ceramic core illustrated schematically in FIG. 1 is intended to form a cavity in a metal airfoil which is a blade. The cast metal airfoil, that is, the blade, is used in a turbine engine. The turbine engine may be used in a vehicle, such as an aircraft. Alternatively, the metal blade formed using the ceramic core 10 may be used in a stationary turbine engine. It is contemplated that the ceramic core may be constructed so as to have a configuration which corresponds to the configuration of a cavity in a metal vane which is used in a turbine engine.

The specific ceramic core 10 illustrated in FIG. 1 is integrally formed as one piece and has a tip end portion 14 and a root end portion 16. A body portion 18 extends between the tip and root end portions 14 and 16. The body portion 18 of the ceramic core 10 includes an airfoil portion 20. It is contemplated that the ceramic core 10 may have a configuration other than the specific configuration illustrated in FIG. 1.

Figure 3:
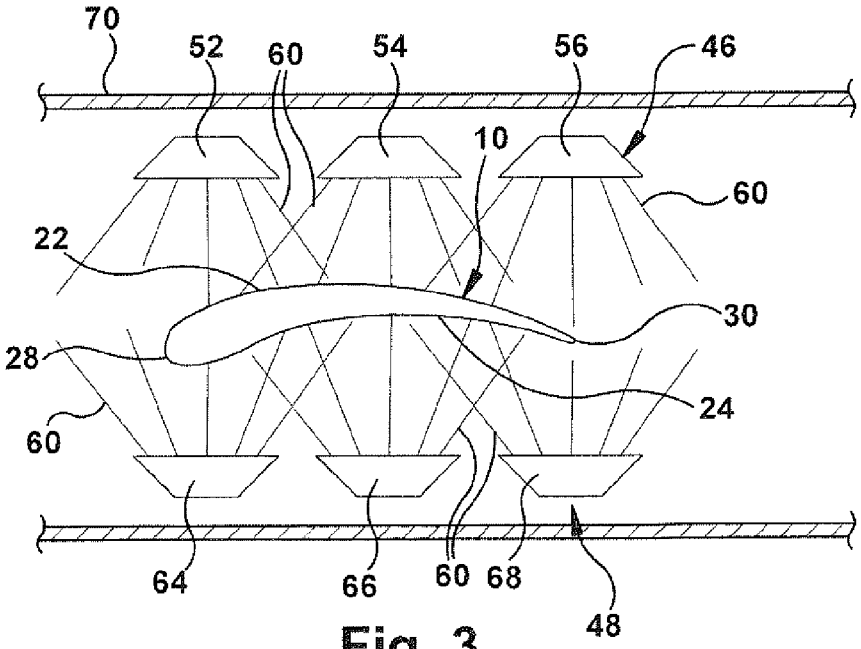
FIG. 3 is a schematic illustration depicting the manner in which the ceramic core of FIG. 1 is positioned between a plurality of arrays of burners and in which flames are directed from the burners against surfaces on opposite sides of the ceramic core.

The airfoil portion 20 of the ceramic core 10 has convex and concave major side surfaces 22 and 24 (FIG. 3). The airfoil portion 20 (FIG. 1) has a arcuate cross sectional configuration with a leading edge portion 28 and a trailing edge portion 30 (FIGS. 1 and 3). The convex and concave major side surfaces 22 and 24 of the airfoil portion 20 have configurations which are a function of the desired configuration of a cavity to be formed in a cast metal airfoil. However, if desired, the ceramic core 10 may be used to form cavities in airfoils formed of materials other than metal.

Openings 24 and/or slots 26 (FIG. 1) may be formed in the ceramic core 10. The openings 24 and/or slots 26 may extend between the tip and root portions 14 and 16 of the ceramic core 10. For example, the slots 26 may extend from the root portion 16 to the tip portion 14 of the ceramic core. Alternatively, the slots 26 may be formed in just the airfoil portion 20 of the ceramic core 10. The openings 24 may have relatively complex configurations and may be interconnected by slots similar to the slots 26. It should be understood that the ceramic core 10 may have any one of many known configurations including, but not limited to, the configurations disclosed in U.S. Pat. No. 5,296,308.

Figure 2:
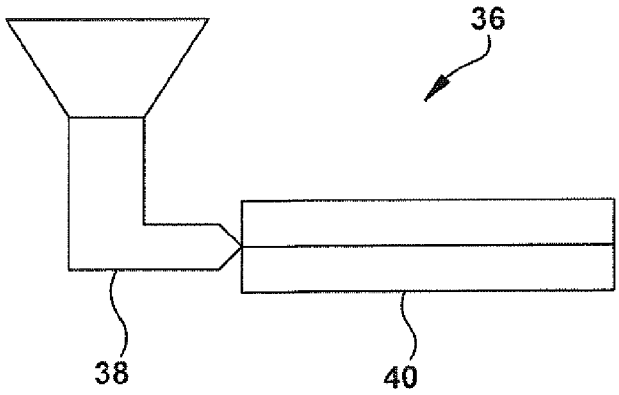
FIG. 2 is a schematic illustration depicting shaping of a ceramic mixture to form the ceramic core of FIG. 1.

The ceramic core 10 can be formed by many different known techniques including, but not limited to, injection molding, transfer molding, compression molding, die pressing, investment casting, extrusion, and/or combinations of these known processes. A known injection molding apparatus 36 (FIG. 2) includes an extruder 38 from which ceramic material is forced into a cavity in a die 40.

The ceramic material injected into the cavity in the die 40 (FIG. 2) by the extruder 38 can be formed of a mixture of many different known materials. For example, ceramic oxides, such as silica, alumina and/or Yittria may be provided in a thick ceramic slurry which is injected into the die 40. The ceramic material injected into a cavity in the die 40 may include flour, binder and various additives. The binder may be an organic binder containing various additives. The binder may include thermosetting and/or thermoplastic resins. It is contemplated that polyethylene, polystyrene, carbowax, ethyl silicate, phenoformaldehydre and/or polyvinyl alcohols may be included in the thick ceramic slurry which is injected from the extruder 38 into the die 40 to form the ceramic core 10.

In accordance with one of the features of the present invention, the ceramic core 10 is removed from the die 40 and positioned between a plurality of arrays 46 and 48 of burners in the manner illustrated in FIG. 3. Although only two arrays 46 and 48 of burners have been illustrated schematically in FIG. 3, it should be understood that a smaller or larger number of arrays of burners may be utilized if desired. Although only one core 10 is illustrated in FIG. 3 as being disposed between the two arrays 46 and 48 of burners, a larger number of ores may be positioned between the two arrays of burners. When a plurality of cores 10 are positioned between the arrays 46 and 48 of burners, the cores may have the same construction. Alternatively, some of the cores positioned between the arrays 46 and 48 of burners may have one construction while other cores positioned between the arrays of burners may have a different construction.

The array 46 of burners is illustrated in FIG. 3 as including only three burners 52, 54, and 56. However, it is contemplated that a smaller or larger number of burners may be provided in the array 46 of burners. For example, the array 46 of burners may include eight or more burners disposed in a rectangular array. The burners in the array 46 of burners are effective to simultaneously direct flame, indicated schematically at 60 in FIG. 3, against the convex side 22 of the ceramic core 10.

Similarly, burners 64, 66 and 68 (FIG. 3) in the array 48 of burners are effective to simultaneously direct flame 60 against the concave side surface 24 of the ceramic core 10. Although only three burners 64, 66 and 68 have been illustrated in FIG. 3 in the array 48 of burners, it is contemplated that either a smaller or larger number of burners may be included in the array 48 of burners. Thus, the array 48 of burners may include eight or more burners disposed in a rectangular array. Although it is believed that it may be desired to have the same number of burners in the array 46 of burners as in the array 48 of burners, it is contemplated that the arrays 46 and 48 may contain different numbers of burners if desired.

The arrays 46 and 48 of burners are enclosed by a stationary housing 70. The housing 70 has four upright insulated walls with a door. The housing 70 has an open bottom which is spanned by a metal grate. A fume hood is disposed above the housing 70.

Flames 60 (FIG. 3) from the arrays 46 and 48 of burners simultaneously impinge against the opposite side surfaces 22 and 24 of the ceramic core 10. The flames 60 are effective to burn organic material contained in the ceramic core 10. The organic material may include excess binder material which is burned off from the ceramic core 10 while the ceramic core is disposed between the arrays 46 and 48 of burners. Although the flames 60 have been shown schematically in FIG. 3 as simultaneously impinging against the convex and concave side surfaces 22 and 24 of the ceramic core, it is contemplated that opposite sides of the ceramic core 10 may be sequentially exposed to the flames 60.

The opposite sides of the ceramic core 10 are simultaneously exposed to the flames 60 throughout the extent of the ceramic core. Thus, both the tip and root portions 14 and 16 of the ceramic core are engaged by the flames 60. Of course, surfaces which are disposed between the tip and root portions 14 and 16 are engaged by the flames 60 from the arrays 46 and 48 of burners. Thus, opposite sides of the ceramic core 10 are simultaneously engaged by the flames 60 throughout the length and width of the core. Although only a single ceramic core 10 is illustrated in FIG. 3, it is contemplated that a plurality of cores may be processed at a time.

The ceramic core 10 may be formed of many different materials. However, the illustrated ceramic core 10 is at least partially formed of a polymorphic material, for example, silica. As the ceramic core 10 is exposed to the flames 60 from the arrays 46 and 48 of burners and excess organic material in the ceramic core is burned, the crystallographic structure or form of the ceramic material forming the core 10 may change. Although the ceramic material of the core 10 may polymorph during exposure to the flame 60, it is believed that very little or no cristobalite is formed at this time. However, it should be understood that the ceramic core 10 may be heated at sufficiently high temperatures to enable cristobalite to form while the ceramic core 10 is disposed between the arrays 46 and 48 of burners.

During burning off of the excess organic material contained in the ceramic core 10, the surface temperature of the core may be between 1,300° to 2,500° F. The ceramic core 10 may be exposed to the flame 60 from the arrays 46 and 48 of burners for a period of approximately 1 to 3 minutes. The ceramic core may be exposed to a cool down cycle of 1 to 4 minutes of compressed air to reduce core temperature. During this relatively short period of time, excess organic materials are burned off from the ceramic core 10. Of course, a longer or shorter burn off and/or cool off time may be utilized.

The ceramic core 10 is not subjected to any heat treatment before burn off of excess organic materials by the arrays 46 and 48 of burners. Thus, the ceramic core 10 is positioned between the arrays 46 and 48 of burners in the same condition as when the ceramic core is removed from the die 40. If desired, the ceramic core 10 may be subjected to an initial heat treatment before being positioned between the arrays 46 and 48 of burners. However, such an initial heat treatment would have the disadvantage of increasing the time required the process the ceramic core 10.

After the organic materials have been burned off from the ceramic core 10, the ceramic core may be dipped in a ceramic material. This ceramic material may contain silica and/or other materials. If desired, a ceramic material other than silica may be used in the dip. Dipping the core in a ceramic material results in the deposition of ceramic material within the ceramic core 10 from which organic materials have been burned.

After the excess organic material in the ceramic core 10 have been burned off using the arrays 46 and 48 of burners in the manner illustrated schematically in FIG. 3 and after dipping of the ceramic core in a ceramic material to deposit ceramic in the core, the ceramic core is sintered in a kiln. This is accomplished by positioning the ceramic core in a known kiln and heating the ceramic core to a temperature sufficient to sinter the core, that is, to a temperature above 1,800° F.

As this sintering takes place, cristobalite is formed in the ceramic core 10. The ceramic material deposited within the ceramic core 10 after the burning away of excess organic materials is also sintered and fills any voids which were formed adjacent to the surface of the ceramic core during the process of burning away the excess organic binder materials. However, it should be understood that the step of dipping the ceramic core 10 in a ceramic material after burning away of excess organic binder materials may be omitted if desired. If the ceramic material is applied to the ceramic core 10 after the burning away of excess organic material, the step of dipping the ceramic core in ceramic material is performed prior to additional heat treatment of the ceramic core.

In accordance with another feature of the present invention, a longitudinal central axis 74 (FIG. 1) of the ceramic core 10 is in an upright orientation during burning way of the excess organic material contained in the ceramic core. Thus, the ceramic core 10 is oriented with its longitudinal central axis 74 upright, that is, in a generally vertical orientation. By having the ceramic core 10 in an upright orientation between the arrays 46 and 48 of burners, in the manner illustrated schematically in FIG. 3, any deformation of the ceramic core during the burning away of excess organic material is minimized. Therefore, when the ceramic core 10 is subsequently positioned in a coordinate measuring machine, better dimensional data is obtained for the ceramic core. Any deviations of the ceramic core from desired measurements is minimized, thereby enabling tolerance ranges for the various dimensions of the ceramic core 10 to be minimized.

Figure 4:
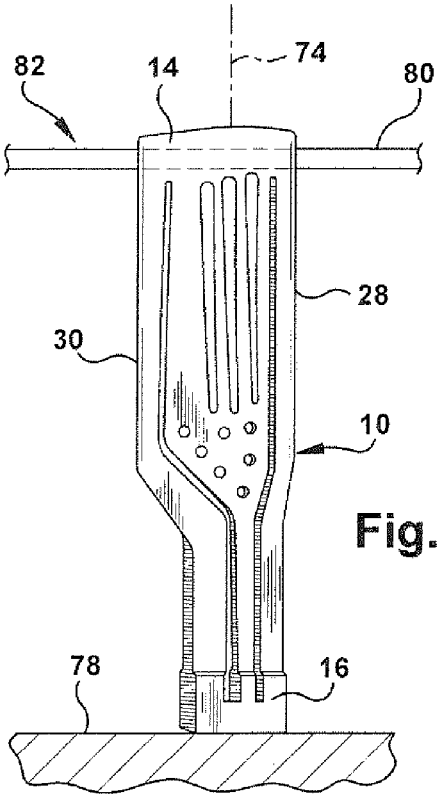
FIG. 4 is a schematic illustration depicting one manner of supporting the ceramic core of FIG. 1 in an upright orientation between the arrays of burners of FIG. 3.

When the ceramic core 10 is positioned between the arrays 46 and 48 of burners, as illustrated in FIG. 3, the ceramic core is supported in the upright orientation of FIG. 4. The ceramic core 10 may be supported in the upright orientation of FIG. 4 by having the root end portion 16 of the ceramic core 10 engage a support surface 78. The tip end portion 14 of the ceramic core 10 engages a cylindrical support surface 80 disposed above the support surface 70.

In the embodiment illustrated in FIG. 4, the support surface 80 is disposed on a cylindrical rod 82 having a longitudinal central axis which extends generally parallel to the support surface 78. The relatively flat support surface 78 and rod 82 are both stationary. Therefore, the ceramic core 10 does not move relative to the arrays 46 and 48 of burners when the ceramic core is disposed between the burners in the manner illustrated in FIG. 3 and supported in the manner illustrated in FIG. 4.

If desired, a suitable connector may hold the tip end portion 14 of the ceramic core 10 against movement relative to the support surface 80. Similarly, a suitable connector may hold the root end portion 16 against movement relative to the support surface 78. It is contemplated that the tip and/or root end portions 14 and/or 16 may be engaged by a gripper or grippers. If desired, the gripper or grippers may be provided with flexible surfaces which engage the ceramic core 10. The gripper or grippers may have surfaces with configurations which correspond to the configuration of the portion or portions of the ceramic core 10 engaged by the gripper or grippers.

The central axis 74 (FIG. 4) of the ceramic core 10 is shown in an upright orientation in FIG. 4. However, the central axis 74 of the ceramic core 10 is skewed by a small angle from vertical when the ceramic core 10 is supported in the upright orientation of FIG. 4. This enables the ceramic core 10 to lean against the support surface 80. The weight of the core 10 is transmitted through the relatively thick root end portion 16 of the ceramic core to the flat support surface 78.

Rather than being engaged by a single support rod 82, in the manner illustrated schematically in FIG. 4, a pair of support rods may be provided to engage the tip end portion 14 of the upright ceramic core 10. The two support rods would extend generally parallel to each other and would engage opposite sides of the tip end portion 14 of the ceramic airfoil 10. This would result in the tip end portion 14 of the ceramic airfoil 10 being held against tipping movement in a direction perpendicular to the support rods. If this is done, the central axis 74 of the ceramic core 10 would be vertical.

If desired, a pair of rods may also be positioned in engagement with opposite sides of the root end portion 16 of the upright ceramic core 10. This would further retain the root end portion 16 of the upright ceramic core 10 against sideways movement during burning off of the excess organic material contained in the ceramic core by the arrays 46 and 48 of burners. If a pair of support rods are utilized to support or hold the tip end portion 14 and/or the root end portion 16 of the upright ceramic core 10, it is contemplated that the support rods could be pressed lightly against opposite sides of the tip end portion 14 and/or root end portion 16 by suitable springs or under the influence of gravity.

Rather than utilizing a cylindrical rod 82 to support the tip end portion 14 of the upright core 10, in the manner illustrated schematically in FIG. 4, a support surface having an arcuate configuration corresponding to the desired configuration of the tip end portion 14 of the ceramic core 10 may be utilized. If this is done, the support surface would form a saddle against which the tip end portion 14 of the ceramic core 10 would rest. It is contemplated that a pair of support surfaces or saddles may be provided to engage opposite sides of the tip end portion 14 of the ceramic core 10. If this is done, the support surface which engages the convex side surface 22 of the tip end portion 14 would have an arc of curvature corresponding to the arc of curvature of the convex side surface 22 at the tip end portion of the core 10. Similarly, the support surface which engages the concave side surface 24 of the tip end portion 14 would have a configuration corresponding to the configuration of the concave side surface of the core 10 at the tip end portion 14 of the core.

It is contemplated that a setter block may be used to hold the upright or angled core 10 against movement relative to the support surface 78. An additional clamp may be used at the root or tip of the ceramic core.

It is contemplated that a clamp may be used to hold the root end portion 16 of the upright core 10 against movement relative to the support surface 78. The clamp may have flat surfaces which are pressed against opposite sides of the root end portion 16 by springs. Of course, other types of connectors may be provided to hold the tip end portion 14 and/or root end portion 16 of the ceramic core 10. If a clamp is utilized to grip the root end portion 16 of the ceramic core 10, a support surface for the tip end portion may be omitted.

It should be understood that the upright ceramic core 10 is supported by the support surfaces 78 and 80 with the ceramic core disposed between the two arrays 46 and 48 (FIG. 3) of burners. Thus, flames 60 from the array 46 of burners are directed against the convex side 22 of the ceramic core 10 while the ceramic core is supported by the support surfaces 78 and 82. At the same time, flames 60 are directed from the burners of the array 48 of burners against the concave side surface 24 while the ceramic core 10 is supported between the two arrays 46 and 48 of burners by the support surfaces 78 and 80. Thus, flames from burners on opposite sides of the core 10 simultaneously impinge against the opposite sides of the core while the core is supported in the upright orientation illustrated in FIG. 4 by the support surfaces 78 and 80. While only a single core 10 is illustrated in FIG. 4, a plurality of cores may be supported in upright orientations by the support surfaces 78 and 80 with the cores disposed between the arrays 46 and 48 of burners.

In order to promote uniform heating of the ceramic core 10 and burning of organic materials from the ceramic core, the upright ceramic core is disposed midway between the arrays 46 and 48 (FIG. 3) of burners. The rate of gas flow to each of the burners is the same. Thus, the same rate of gas flow is provided to all of the burners in the array 46 of burners as is provided to the burners in the array 48 of burners.

However, it is contemplated that the rate of flow of gas to some of the burners in at least one of the arrays 46 or 48 of burners may be greater than the rate of gas flow to other burners. For example, the rate of gas flow to the burner 52 in the array 46 of burners and the rate of gas flow to the burner 64 in the array 48 of burners may be greater than the rate of flow of gas to the burners 54 and 56 in the array 46 and the rate of flow of gas to the burners 66 and 68 in the array 48. The increased rate of gas flow to the burners 52 and 64 promotes burning of organic materials from the relatively thick leading end portion 28 of the ceramic core 10.

Similarly, different rates of gas flow may be provided to burners having flames 60 which impinge against the tip end portion 14 of the ceramic core than to burners having flames which impinge against the root end portion 16 of the ceramic core. Of course, all of the burners in the arrays 46 and 48 of burners may be supplied with gas at the same flow rate.

In the embodiment of the invention illustrated in FIG. 3, the burners in the arrays 46 and 48 of burners have centers disposed in parallel vertical planes located adjacent opposite sides of the upright ceramic core 10. It is contemplated that the burners in the arrays 46 and 48 of burners may have centers located in arcuately curving arrays. For example, the burners in the array 46 of burners may be arranged with their centers disposed in an arcuately curving plane having an arc of curvature which corresponds to the arc of curvature of the convex side surface 22 of the ceramic core 10. Similarly, the burners in the array 48 of burners may have centers disposed in a plane having an arc of curvature which corresponds to the arc of curvature of the concave side surface 24 of the ceramic core 10.

By simultaneously directing flames 60 towards the ceramic core 10 from burners which are located in either flat or arcuate planes at the same distance from the ceramic core and by directing flames in the arrays 46 and 48 having a vertical extent which is somewhat greater than the vertical extent (as viewed in FIG. 1) of the ceramic core 10, uniform heating of the ceramic core throughout its length and width is promoted. Therefore, there tends to be a uniform heating of the ceramic core 10 and uniform burning of the organic materials from the ceramic core by the arrays 46 and 48 of burners. Of course, the spacing of the burners and/or the rate of flow of gas to the burners may be adjusted to heat one portion of the ceramic core to a greater extent than another portion. For example, the burners 52 and 64 adjacent to the relatively thick leading edge portion 28 of the ceramic core may be closer to the ceramic core or may be supplied with gas at a higher rate than the burners 56 and 68 which are adjacent to the relatively thin trailing edge portion 30 of the ceramic core. As another example, burners disposed adjacent to the relatively thick root end portion 16 of the ceramic core 10 may be closer to and/or supplied with gas at a greater rate than burners closer to the relatively thin tip end portion 14 of the ceramic core 10.

In the embodiment of the invention illustrated in FIGS. 1-4, the upright ceramic core 10 is stationary between stationary arrays 46 and 48 of burners during the simultaneous direction of flame 60 against opposite sides 22 and 24 of the ceramic core. In the embodiment of the invention illustrated in FIG. 5, the upright ceramic core 10 is moved along a path extending midway between stationary arrays of burners. The stationary arrays of burners have lengths, in the direction of movement of the ceramic core 10, which is sufficient to enable flames 60 from the burners to impinge against opposite sides of the ceramic core as it is moved relative to the burners. While flames, corresponding to the flames 60 of FIG. 3, are simultaneously directed against opposite sides of the upright ceramic core 10, the ceramic core is moved slowly along a linear path disposed midway between the burners in a direction indicated schematically by an arrow 90 in FIG. 5.

Figure 5:
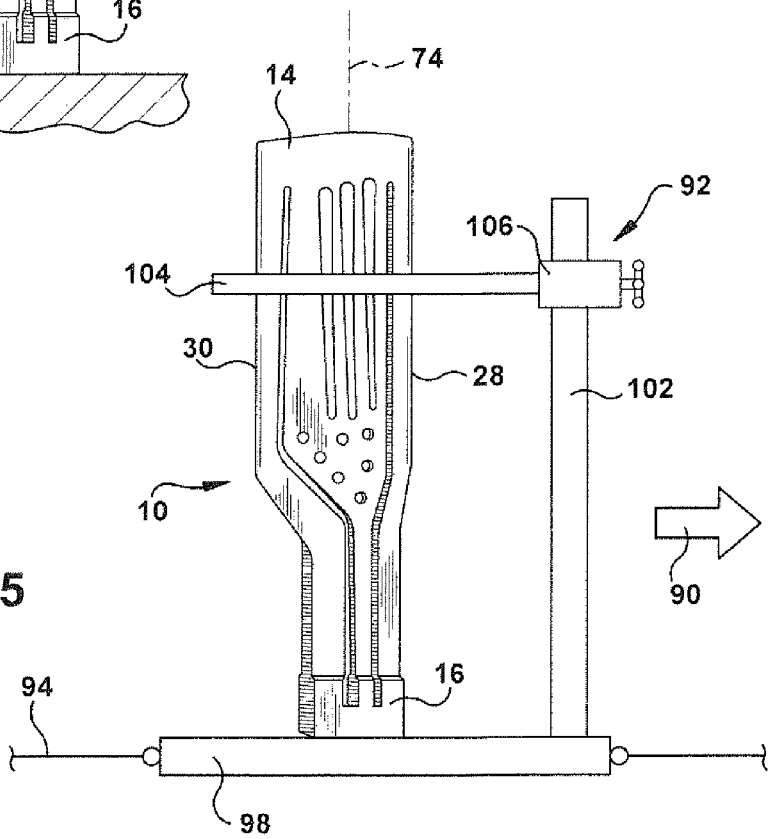
FIG. 5 is a schematic illustration of another manner of supporting the ceramic core of FIG. 1 in an upright orientation between the arrays of burners of FIG. 3.

The upright ceramic core 10 is held by a retainer or holder 92 which is connected with a conveyor 94 (FIG. 5). The conveyor 94 may have any known construction, such as a belt, chain, or link construction. The conveyor 94 is driven at a constant speed so that the holder 92 is moved slowly at a constant speed past elongated arrays of burners, corresponding to the arrays 46 and 48 of burners illustrated schematically in FIG. 3 and disposed on opposite sides of the path of movement of the upright ceramic core 10.

As the ceramic core 10 is moved along the path between the arrays of burners, in the manner indicated schematically by the arrow 90 in FIG. 5, flames 60 are simultaneously directed from burners disposed adjacent to opposite sides of the core 10. Although only a single core 10 has been illustrated schematically in FIG. 5, it should be understood that there are a plurality of upright cores 10 disposed in a linear array extending along the conveyor 94 midway between the arrays of burners disposed adjacent to opposite sides of the cores. The conveyor 94 is effective to simultaneously move all of the upright cores 10 slowly along the path past the stationary arrays of burners.

The holder 92 includes a rectangular base 98 which is connected to the conveyor 94. A flat horizontal upper surface of the base 98 is engaged by the root end portion 16 of the upright ceramic core 10. A post 102 extends vertically upward from the base 98. A horizontal arm 104 is connected with the post 102 by a clamp 106. The clamp 106 is vertically movable along the post 102 to enable the position of the arm 104 to be adjusted to accommodate ceramic cores 10 having different lengths, that is, different extents along the longitudinal central axis 74 of the ceramic core.

Although only one arm 104 is illustrated in FIG. 5, it should be understood that there are a pair of arms connected to the clamp 106. The two arms have generally parallel longitudinal central axes which extend perpendicular to the longitudinal central axis of the post 102. The arms are positioned in engagement with opposite sides of the ceramic core 10 to hold the tip end portion 14 of the ceramic core. One of the two arms which extend from the clamp 106 may be urged toward the other arm to press the one arm against the side of the ceramic core. This results in the upright ceramic core 10 being gripped between the two arms. Alternatively, one of the arms will remain stationary while the other arm is manually moved to a desired position and clamped in place.

In the embodiment illustrated in FIG. 5, a single post 102 is provided. It is contemplated that a pair of parallel post may extend upwardly from the base 98. One of the posts will be located adjacent to the leading end portion 28 of the ceramic core 10 while the opposite post will be located adjacent to the trailing edge portion 30 of the ceramic core. If two posts are utilized in association with the base 98, one of the arms may be secured to the two posts by suitable clamps, corresponding to the clamp 106 of FIG. 5. The other arm may be disposed in a pair of cam tracks which slope downwardly and inwardly toward the core 10 so that the second arm is urged toward the first arm under the influence of gravity. If desired, springs may urge the second arm toward the first arm.

A stationary holder 120 (FIG. 6) engages a tip end portion 14 of the upright ceramic core 10 in the manner generally illustrated schematically in FIG. 5. The holder 120 includes a mounting section 122 which is slidably received on a stationary vertical post 124. The post 124 has been indicated schematically in dashed lines in FIGS. 6 and 7. Suitable fasteners are provided to connect the mounting section 122 to the post 124 when the holder 120 is in a desired position above a lower support surface (not shown in FIG. 6). The holder 120 is movable along the upright post 124 to adjust the position of the holder to accommodate cores 10 having different lengths.

The holder 120 includes a fixed or stationary arm 128 which is fixedly connected to the mounting section 122. The stationary arm 128 has a rectangular base 129 which is fixedly secured to the mounting section 122. The stationary arm 128 has a cylindrical outer end portion 130 which engagable with one side of a ceramic core 10.

A movable arm 132 is pivotally connected with the mounting section 122. The movable arm 132 includes a cylindrical outer end portion 140 which is connected with the mounting section 122 by a pair of links 144 and 146. A coil spring 150 has an outer end portion connected with the movable arm 132 at a pin 152. An inner end portion of the spring 150 is connected to the mounting section 122 at a pin 154. The movable arm 132 is pivotal relative to the links 144 and 146 at a pivot connection formed between an inner end portion of the movable arm 132 and the two stationary links 144 and 146. If desired, the links 144 and 146 may be pivotable relative to the mounting section 122.

Figure 6:
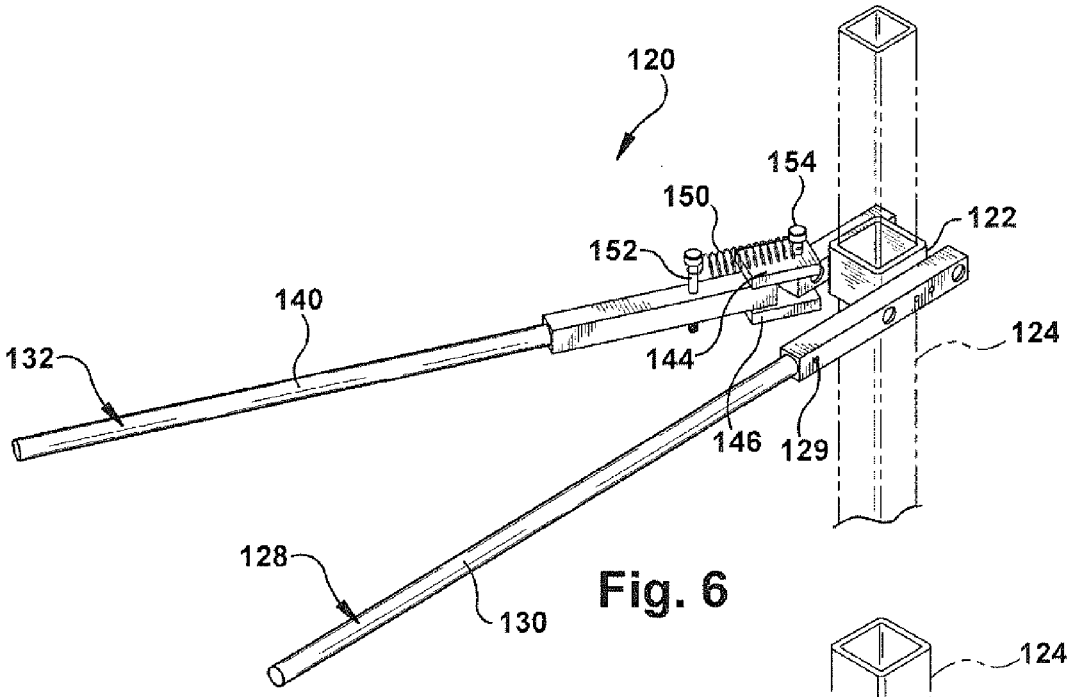
FIG. 6 is a schematic illustration of a holder for use in supporting the ceramic core in an upright orientation between a plurality of arrays of burners, in the manner illustrated in FIG. 3, the holder being shown in an open condition.

When the holder 120 is in the open condition of FIG. 6, the tip end portion 14 of the ceramic core 10 is positioned between the stationary arm 128 and movable arm 132 with the central axis 74 of the airfoil in an upright orientation, as illustrated in FIGS. 4 and 5. The movable arm 132 is then pivoted from the open position of FIG. 6 towards the closed position of FIG. 7. As this occurs, the movable arm 132 of the holder 120 moves into engagement with the tip end portion 14 of the ceramic core 10 and presses the opposite side of the ceramic core against the stationary arm 128.

The spring 150 provides a relatively light biasing force which urges the movable arm 132 toward the closed position (FIG. 7) in which a cylindrical surface on the movable arm is in engagement with the tip end portion 14 of the ceramic core 10. When the tip end portion 14 of the ceramic core is disposed between the movable and stationary arms 132 and 128, the spring 150 moves the movable arm 132 toward the stationary arm 128 until the movable arm 132 is pressed against the tip end portion 14 of the ceramic core. This results in the tip end portion 14 of the upright ceramic ore 10 being gripped between the stationary and movable arms 128 and 132.

It is contemplated that the arrays 46 and 48 (FIG. 3) of burners may be supported in many different ways. In the embodiment illustrated in FIG. 8, burners are supported from parallel stationary vertical posts 162 and 164. Lower end portions of the posts 162 and 164 are fixedly connected to a metal grate (not shown) by mounting brackets 166 and 168. The posts 162 and 164 are disposed within a housing similar to the housing 70 of FIG. 3. The posts 162 and 164 are fixedly connected to the grate which spans the lower end of the housing.

An array 174 of burners is connected with the post 162. Similarly, an array 176 of burners is connected with the post 164. The posts 162 and 164 and the arrays 174 and 176 of burners are disposed adjacent to opposite sides of a ceramic core 10 (FIG. 1) when the ceramic core is disposed within the housing which encloses the posts 162 and 164 and the arrays 174 and 176 of burners. The array 174 of burners may be considered as corresponding to the array 46 of burners illustrated schematically in FIG. 3. Similarly, the array 176 of burners may be considered as corresponding to the array 48 of burners illustrated in FIG. 3.

Figure 8:
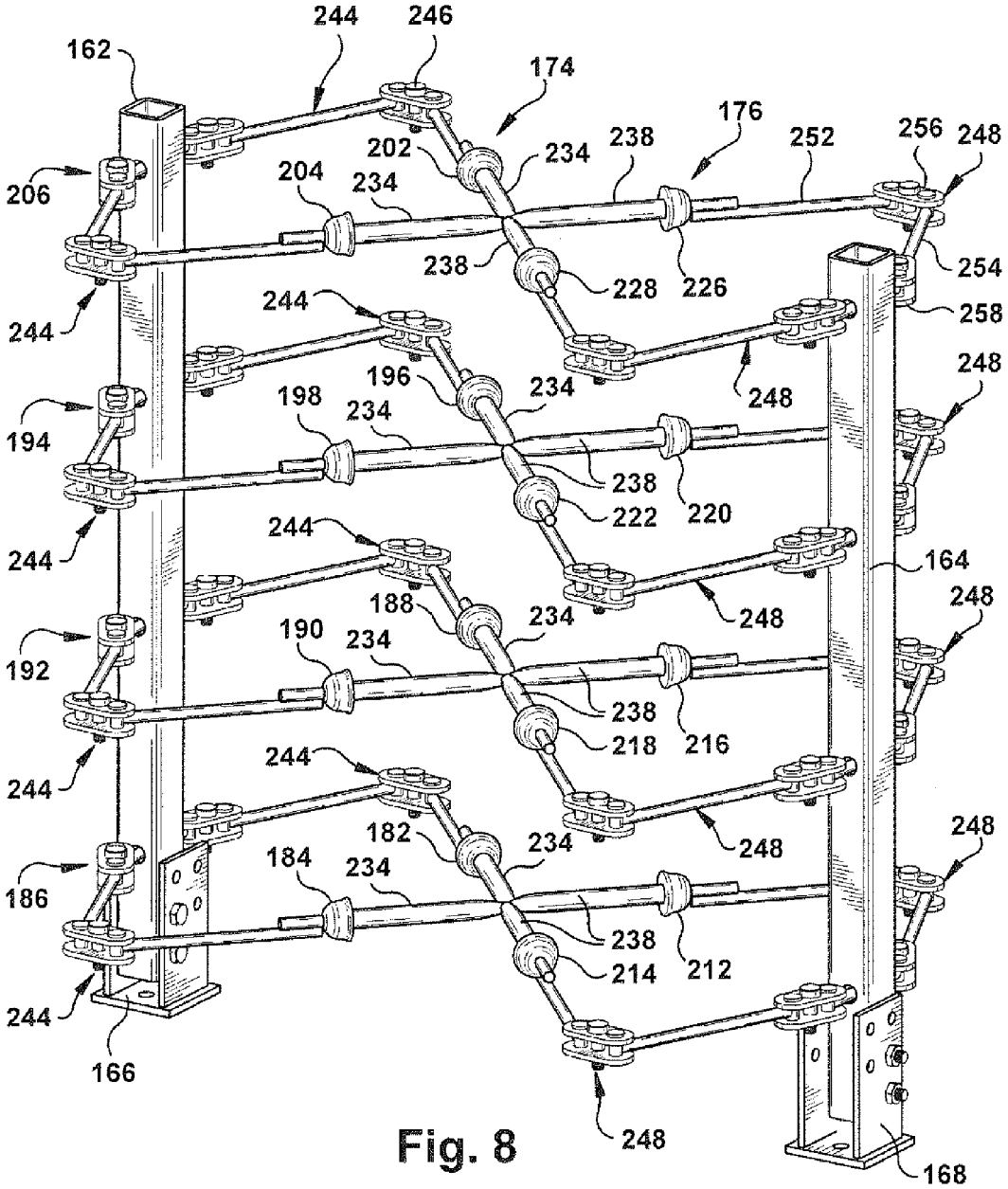
FIG. 8 is a schematic illustration of an apparatus for supporting arrays of burners.

In the embodiment illustrated in FIG. 8 there are two burners disposed at each of four levels in the array 174 of burners. Of course, a greater or lesser number of burners may be provided in the embodiments of FIGS. 3 and/or 8 if desired. Similarly, in the embodiment illustrated in FIG. 8 there are two burners disposed at each of four levels in the array 176 of burners. Of course, a greater or lesser number of burners may be provided at each of the levels in the embodiments of FIGS. 3 and/or 8.

The ceramic core 10 (FIG. 1) is positioned midway between the arrays 174 and 176 (FIG. 8) of burners. Thus, the ceramic core 10 is positioned midway between the upright posts 162 and 164 in a suitable holder. It is contemplated that the holder may have the same construction as the holder 120 of FIGS. 6 and 7.

Figure 7:
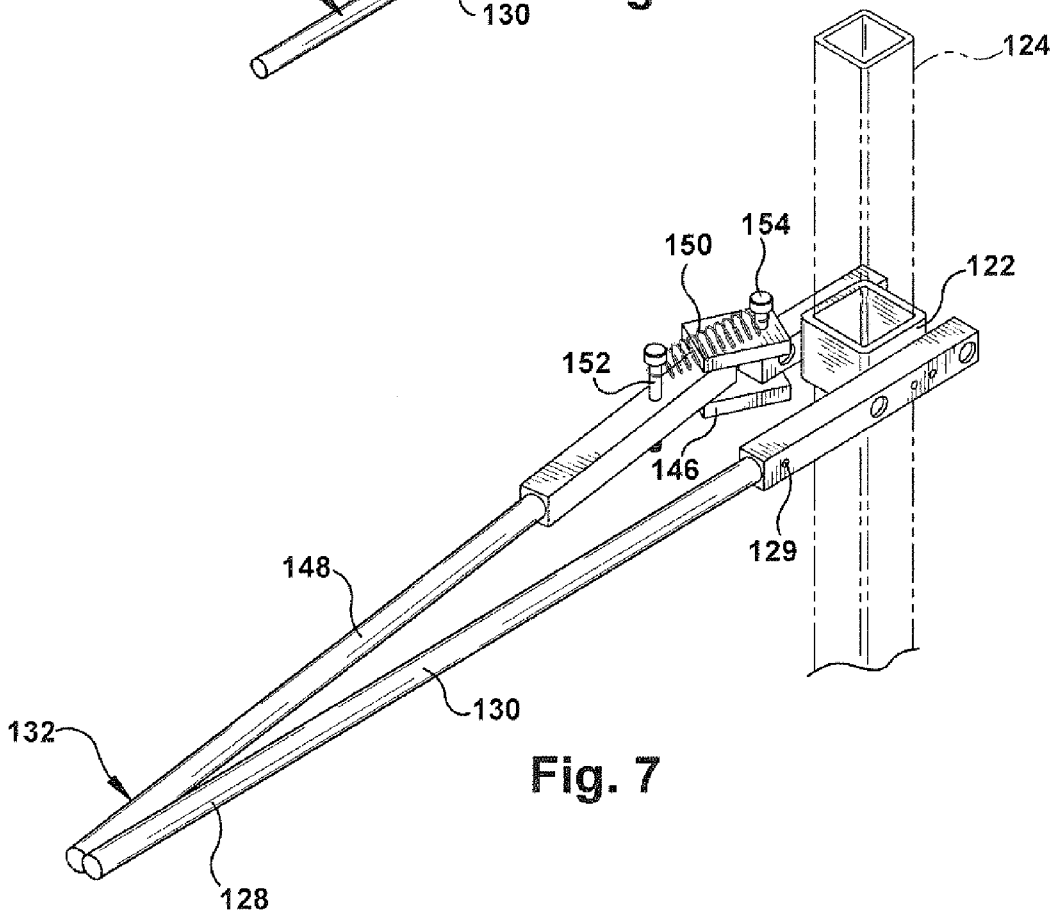
FIG. 7 is a schematic illustration of the holder of FIG. 6 in a closed condition.

Assuming that the holder 120 of FIGS. 6 and 7 is utilized with the arrays 174 and 176 of burners, the post 124 (FIGS. 6 and 7) which supports the holder 120 is positioned midway between the posts 162 and 164 (FIG. 8) and is offset from a plane extending between the posts 162 and 164 in a direction which extends into the drawing (as viewed in FIG. 8). The post 124 for the holder 120 extends parallel to the posts 162 and 164 and is fixedly connected to the grate by mounting brackets similar to the mounting brackets 166 and 168 of FIG. 8.

The holder 120 is oriented so as to hold the ceramic core 10 with its central axis 74 in an upright orientation extending parallel to the central axes of the posts 162 and 164 of FIG. 8. The central axis 74 of the upright ceramic core 10 is positioned by the holder 120 (FIGS. 6 and 7) at a location midway between the posts 162 and 164. The central axis 74 of the ceramic core 10 is positioned by the holder 120 in a plane which extends between the posts 162 and 164 and contains the central axes of the posts 162 and 164 (FIG. 8). The convex side surface 22 of the ceramic core 10 may face toward the array 174 of burners. The concave side surface 24 of the ceramic core 10 may face toward the array 176 of burners. The opposite sides of the ceramic core 10 will be spaced equal distances from the two arrays 174 and 176 of burners.

The array 174 of burners includes burners 182 and 184 disposed at a first or lower level 186 of burners. Burners 188 and 190 are disposed at a second level 192 above the first or lower level 186. Burners 196 and 198 disposed at a third level 194. Burners 202 and 204 disposed at a fourth or upper level 206. The burners in the array of 174 all have the same construction.

Similarly, the array 176 of burners includes burners 212 and 214 disposed at the first or lower level 186. The array 176 of burners includes burners 216 and 218 disposed at the second level 192. Burners 220 and 222 are disposed in the array 176 of burners at the third level 194. Finally, burners 226 and 228 are disposed at the fourth or upper level 206. Flames 234 from the burners in the array 174 of burners have been indicated schematically at 234 in FIG. 8. Similarly, flames from the burners in the array 176 of burners have been indicated schematically at 238 in FIG. 8. The flames 234 from the array 174 of burners and the flames 238 from the array 176 of burners extend along axes which intersect at a vertical plane containing the vertical central axes of the posts 162 and 164. When the ceramic core 10 is held by the holder 120 (FIGS. 6 and 7) and organic material is being burned off from the core, the central axis 74 of the ceramic core 10 is disposed in the vertical plane containing the axes of the posts 162 and 164.

The flames 234 and 238 impinge against opposite sides of the upright ceramic core 10 throughout the extent of the ceramic core. Thus, the flames 234 and 238 engage the convex and concave side surfaces 22 and 24 (FIG. 3) of the ceramic core 10 and the root end portion 16 (FIG. 1) of the ceramic core throughout the extent of the ceramic core. The entire surface of the ceramic core 10 is engaged by flames 234 and 238 from burners in the arrays 174 and 176 of burners during the burning off of organic material from the ceramic core.

The burners in the arrays 174 and 176 of burners are supported by linkage assemblies which are connected to the posts 162 and 164. Thus, the array 174 of burners is supported by identical linkages 244 connected to the post 162. Similarly, the burners in the array 176 of burners are connected to the post 164 by identical linkages 248. The linkages 244 and 248 connected to the posts 162 and 164 have the same construction and are adjustable to support the burners in the arrays 174 and 176 in desired positions relative to posts 162 and 164.

The linkage 248 connected with the upper burner 226 includes a pair of links 252 and 254 which are pivotally connected at a connector 256. The link 254 is pivotally connected to the post 164 at a pivot connection 258. The burner 226 is pivotally connected to the outer link 252. It should be understood that the linkages 244 and 248 have identical constructions and are connected with the posts 162 and 164 and with the burners in the arrays 174 and 176 of burners in the same manner.

In one embodiment the apparatus of FIG. 8, the posts 162 and 164 and the linkages 244 and 248 were disposed outside of a housing corresponding to the housing 70 of FIG. 3. The burners in the arrays 174 and 176 of burners extended through openings in the walls of the housing corresponding to the housing 70 of FIG. 3. The walls of the housing were insulated. By suitably adjusting the linkages 244 and 248 and the burners, the orientation of the burners relative to a ceramic core 10 disposed on a holder, similar to the holder 120 of FIGS. 6 and 7, can be adjusted. Alternatively, the posts 162 and 164 and linkages 244 and 248 may be disposed within housing corresponding to the housing 70 of FIG. 3.

Figure 9:
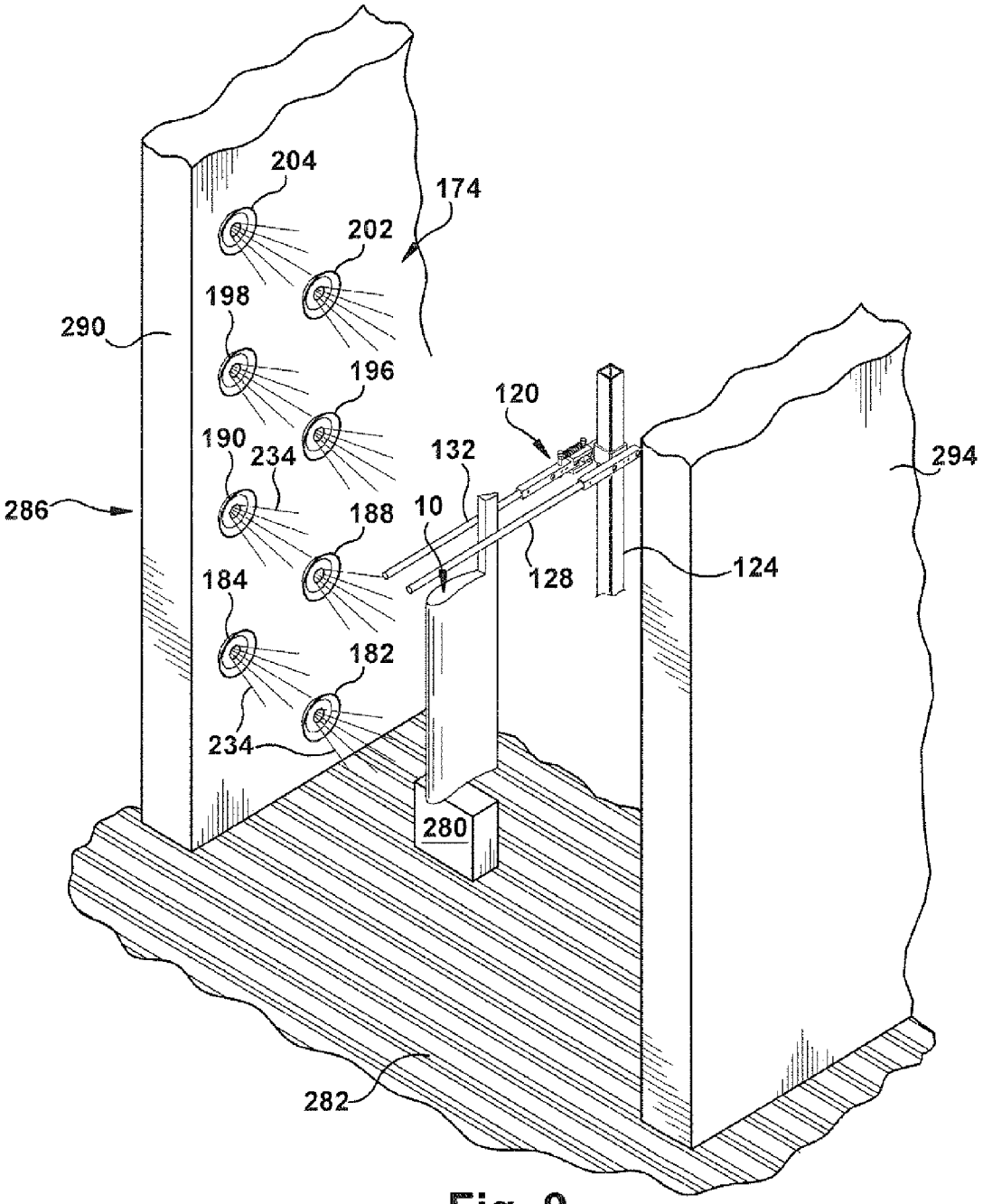
FIG. 9 is a schematic pictorial illustration depicting the directing of flames against a ceramic core while the ceramic core is disposed between arrays of burners.

The manner in which flames 234 from the burners in the array 174 (FIG. 8) of burners are directed toward a ceramic core 10 is illustrated schematically in FIG. 9. The ceramic core 10 has a lower end portion (root end portion 162) supported on a support block 280 fixedly connected with a grate 282. The upper end portion (tip end portion 14) of the ceramic core 10 is supported by the holder 120 of FIGS. 6 and 7. The holder 120 (FIG. 9) is mounted on a post 124 which is fixedly connected to the grate 282 and extends vertically upward from the grate. The post 124, holder 120, and the ceramic core 10 are enclosed by an insulated rectangular housing 286 which is supported on and is fixedly connected to the grate 282. A fume hood (not shown) extends across the upper end of the housing 286 and exhausts fumes from the housing.

The burners 182 through 204 in the array 174 (FIG. 8) of burners extend through openings formed in a wall 290 (FIG. 9) of the housing 286. The burners 182 through 204 are connected with a post, corresponding to the post 162 of FIG. 8, by linkages corresponding to the linkage 244. The post to which the burners 182 through 204 are connected is outside the housing 286 and has not been illustrated in FIG. 9. However, it should be understood that the post has the same construction as the post 162 of FIG. 8 and is connected with the grate 202 by a mounting bracket corresponding to the mounting bracket 166 of FIG. 8. If desired, the post 162 may be skewed from an upright orientation.

Although only the burners 182 through 204 in the array 174 of burners have been illustrated schematically in FIG. 9, it should be understood that burners corresponding to the burners 212 through 228 in the array 176 of burners (FIG. 8) extend through openings formed in a second wall 294 of the housing 286. The post 164 and linkages 248 for supporting the burners associated with the wall 294 have not been illustrated schematically in FIG. 9.

Flames, corresponding to the flames 234 and 238 of FIG. 8, from burners extending through openings in the walls 290 and 294 of the housing 286 are directed against opposite sides of the upright ceramic core 10. The upright ceramic core 10 is illustrated schematically in FIG. 9 and has a relatively short vertical extent. Therefore, the upper burners 196 through 204 in the array 174 of burners and the upper burners 220 through 228 in the array 176 of burners (FIG. 8) are inactive. It should be understood that the active burners in the arrays 174 and 176 of burners are effective to direct the flames 234 and 238 (FIG. 8) against opposite sides of the ceramic core 10 (FIG. 9) throughout the extent of the core. Of course, if the ceramic core 10 has a greater vertical extent, the burners in the upper portions of the arrays 174 and 176 of burners would be activated.

Figure 10:
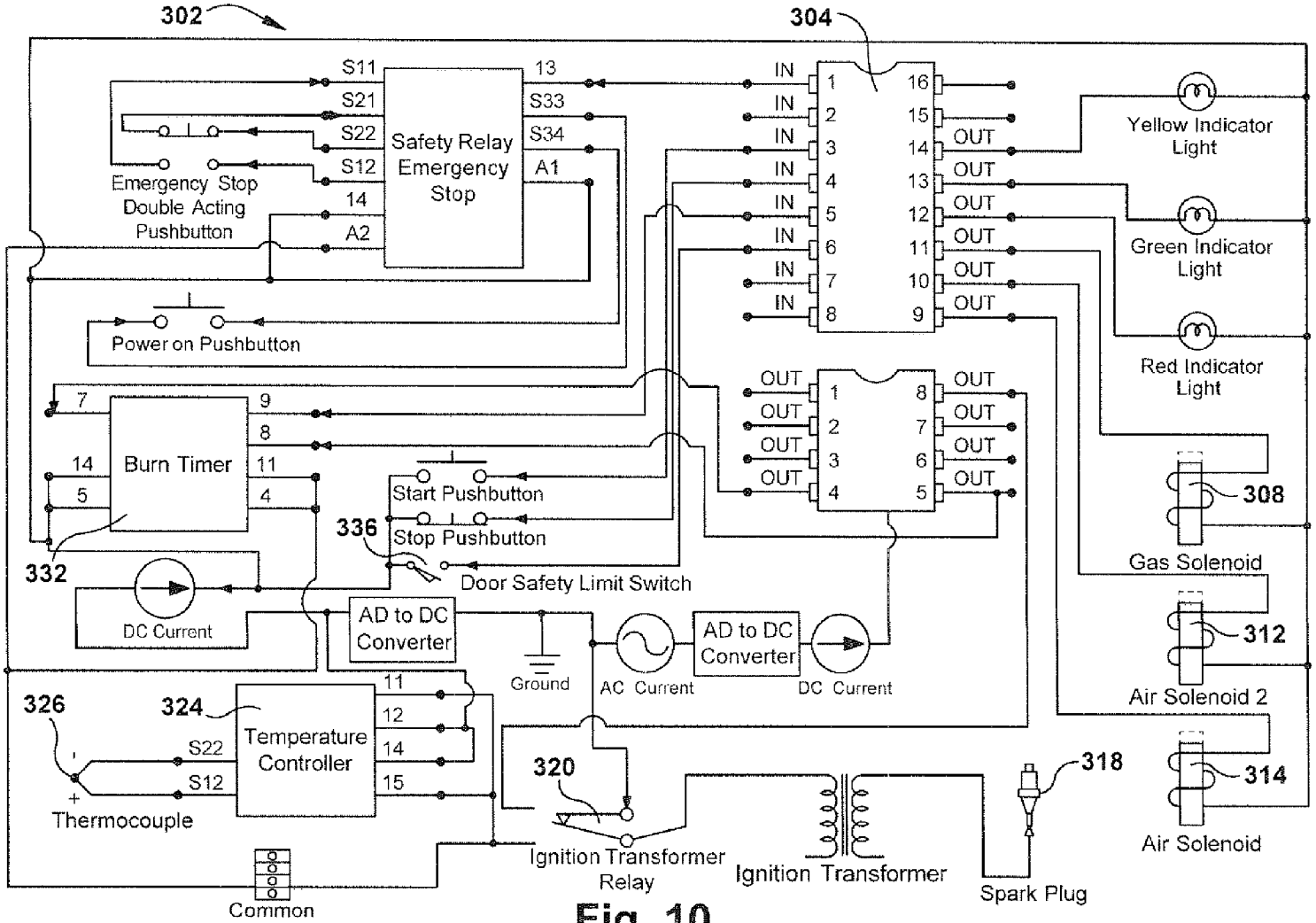
FIG. 10 is a schematic illustration of control apparatus for use in controlling the arrays of burners illustrated in FIGS. 3 and 8.

Controls 302 for the apparatus of FIGS. 3-9 are illustrated schematically in FIG. 10. The controls 302 include a computer or controller 304. The controller 304 is connected with a plurality gas solenoids 308 to control the flow of gas to the various burners, corresponding to the burners in the arrays 46 and 48 of burners in FIG. 3 or the burners in the arrays 174 and 176 of burners in FIG. 8. It should be understood that although only a single gas flow control solenoid 308 has been illustrated schematically in FIG. 10, there is a gas flow control solenoid for each of the burners in the arrays 46 and 48 and in the arrays 174 and 176. Each of the gas flow control solenoids is actuated by the computer 304 to control the rate of flow of gas to the associated burner.

Air flow control solenoids 312 and 314 also are provided in association with each of the burners. Although only two air flow control solenoids 312 and 314 have been illustrated schematically in FIG. 10, it should be understood that there are two air flow control solenoids 312 and 314 associated with each of the burners in the arrays 46 and 48 and the arrays 174 and 176 of burners. The airflow control solenoids 312 and 314 are actuatable to adjust the rate of flow of air to the associated one of the burners. Both the rate of flow of air to each burner and the rate of flow of gas to each burner is controlled by the computer 304 in association with the solenoids 308, 312, and 314.

A spark plug 318 is associated with each of the burners in the arrays 46 and 48 (FIG. 3) or the arrays 274 and 276 (FIG. 8) of burners. A spark from a spark plug 318 associated with a burner effects ignition of a flow of gas from the burner. The spark plug for a burner is energized through a transformer relay 320. Although only a single spark plug and transformer relay 320 have been illustrated schematically in FIG. 10, it should be understood that a spark plug and ignition transformer relay are associated with each of the burners in the arrays 46 and 48 (FIG. 3) or the arrays 174 and 176 of burners.

A temperature controller 324 is associated with each of the burners in the arrays 46 and 48 of burners or the arrays 174 and 176 of burners. The temperature controller 324 is connected with thermocouples 326. Although only a single thermocouples 326 has been illustrated schematically in FIG. 10, there are a plurality of thermocouples. If desired, a separate thermocouple can be provided in association with each of the burners in the arrays 46 and 48 of burners (FIG. 3) or the arrays 174 and 176 (FIG. 8) of burners. The thermocouples 326 enable the computer 304 to control the rate of flow of gas and/or air to the burners as a function of temperature. This enables the computer 304 to control the flames which are directed from the burners against the opposite sides of the upright ceramic core to obtain uniform burning of organic material over the extent of the ceramic core. Of course, the computer 304 may actuate the solenoids 308, 312 and/or 314 to have one portion of a ceramic core 10 at a higher temperature than another portion of the ceramic core.

A burn timer 332 is provided in association with the computer 304 to control the length of time for which the burners in the arrays 46 and 48 (FIG. 3) or the arrays 174 and 176 (FIG. 8) of burners direct flame against the opposite side surfaces of the upright ceramic core 10. Suitable start and stop controls and safety relays are provided by the controls 302. A door safety limit switch 336 is actuated by opening and closing of a door associated with the housing 70 (FIG. 3) or the housing 286 (FIG. 9) to shut off the flow of gas and air to the burners when the door to the housing is open. It should be understood that the controls 302 (FIG. 10) schematically illustrate one embodiment of the controls which may be utilized in association with the apparatus of FIGS. 3 through 9. However, controls having a different construction may be utilized if desired.

Once the organic materials have been burned off from the ceramic core 10, the burners in the arrays 46 and 48 (FIG. 3) or the arrays 174 and 176 (FIG. 8) of burners are extinguished. The ceramic core may then be positioned on a setter block and heated ((sintered) in a kiln in a known manner. The sintered core is then used in the casting of an article, such as the blade or vane of a turbine engine.

When the sintered core 10 is to be used in casting an airfoil, such as a blade or vane, the core is at least partially covered with natural or synthetic wax having a configuration corresponding to the desired configuration of a cavity in the blade or vane. This ceramic core 10 and wax covering form a pattern assembly which is covered with liquid ceramic mold material by repetitively dipping the pattern assembly in a slurry of liquid ceramic material. After the ceramic mold material has been at least partially dried, the resulting mold is heated to melt the wax. After the wax has been removed from the mold, molten metal is poured into the cavity left by the removal of the wax. After the molten metal has solidified to form an airfoil having a desired configuration, the ceramic core 10 is removed from the cast metal airfoil.

CONCLUSION

In view of the foregoing description, it is clear that the present invention provides a new and improved method of making a core 10 which is used in casting of an airfoil having an internal cavity. To make the core 10, a ceramic mixture is shaped to form a ceramic core having a configuration which is a function of the configuration of the cavity in the airfoil. The injection molding apparatus 36 (FIG. 2) may be used to form the ceramic core 10.

Once it has been formed, the ceramic core 10 may be positioned between the plurality of arrays of burners. Thus, the ceramic core 10 may be positioned between the arrays 46 and 48 (FIG. 3) of burners or between the arrays 174 and 176 of burners (FIGS. 8 and 9). Flames from the arrays of burners are directed against surfaces on opposite sides of the ceramic core 10. This results in a burning of organic material contained in the ceramic core 10. The ceramic core may, advantageously, be supported with a central axis 74 of the ceramic core in an upright orientation during burning of the organic material contained within the ceramic core.

Having described the invention, the following is claimed:

1. A method of making a core for use in casting an airfoil having an internal cavity, said method comprising the steps of shaping a ceramic mixture to form a ceramic core having a configuration corresponding to the configuration of the cavity in the airfoil, positioning the ceramic core between a plurality of arrays of burners and on a holder with a first end portion of the ceramic core engaging a first support surface and with a second end portion of the ceramic core engaging a second support surface, the second support surface being disposed above the first support surface, directing flames from the arrays of burners against surfaces on opposite sides of the ceramic core with the first end portion of the core engaging the first support surface and the second end portion of the core engaging the second support surface, and burning organic material contained in the ceramic core while flames from the arrays of burners are directed against surfaces on opposite sides of the ceramic core.

2. A method as set forth in claim 1 wherein said step of directing flames against surfaces on opposite sides of the ceramic core is performed with a central axis of the ceramic core in an upright orientation.

3. A method as set forth in claim 1 further including the step of dipping the ceramic core in a ceramic material after having performed said step of directing flames against the surfaces on opposite sides of the ceramic core, said step of dipping the ceramic core in ceramic material being performed after directing flames against the surfaces on opposite sides of and prior to additional heat treatment of the ceramic core.

4. A method as set forth in claim 3 further including heating the ceramic core in a kiln after having performed said step of dipping the ceramic core in ceramic material.

5. A method as set forth in claim 1 wherein said step of directing flames from the arrays of burners against opposite sides of the ceramic core includes simultaneously directing flames against surfaces on opposite sides of the ceramic core.

6. A method as set forth in claim 1 wherein said step of burning organic material contained in the core includes simultaneously burning organic material contained in opposite sides of the ceramic core.

7. A method as set forth in claim 1 wherein said step of shaping a ceramic mixture to form a ceramic core includes forming the ceramic core with a root end portion, a tip end portion, and a body portion which extends between the root and tip end portions and has a configuration which is a function of the configuration of the airfoil, said step of directing flames against surfaces on opposite sides of the ceramic core includes directing flames against a concave surface area on a first side of the body portion and directing flames against a convex surface area on a second side of the body portion.

8. A method as set forth in claim 7 wherein said step of directing flames against a concave surface area on a first side of the body portion is performed simultaneously with performance of said step of directing flames against a convex surface area on a second side of the body portion.

9. A method a set forth in claim 7 wherein said steps of directing flames against a concave surface area on a first side of the body portion and directing flames against a convex surface area on a second side of the body portion are performed with the concave and convex surface areas in upright orientations.

10. A method as set forth in claim 1 wherein said step of directing flames against opposite sides of the ceramic core is performed while the core is stationary.

11. A method as set forth in claim 1 wherein said step of directing flames against opposite sides of the ceramic core is performed while the core is moving.

* * * * *